United States Patent [19]

Simpson

[11] Patent Number: 4,603,986

[45] Date of Patent: Aug. 5, 1986

[54] INK PROJECTING TYPEWRITER RIBBON

[76] Inventor: George R. Simpson, 275 Central Park West, New York, N.Y. 10024

[21] Appl. No.: 271,378

[22] Filed: Jun. 8, 1981

[51] Int. Cl.[4] ..... B41J 31/09

[52] U.S. Cl. ..... 400/241.2; 400/120; 428/914

[58] Field of Search ..... 400/118, 119, 120, 121, 400/124, 241, 241.1, 241.2; 428/913, 914; 346/76 R, 76 L, 76 PH

[56] References Cited

U.S. PATENT DOCUMENTS

| | | | |
|---|---|---|---|
| 3,287,153 | 11/1966 | Schwarz et al. | 400/241.2 X |
| 3,351,948 | 11/1967 | Bonn | 400/120 X |
| 3,962,513 | 6/1976 | Eames | 428/913 X |
| 3,995,729 | 12/1976 | Anton et al. | 400/241.1 X |
| 4,058,644 | 11/1977 | DeVries et al. | 428/914 X |
| 4,060,032 | 11/1977 | Evans | 346/76 L X |
| 4,064,982 | 12/1977 | Anton et al. | 400/241.1 |
| 4,309,117 | 1/1982 | Chang et al. | 400/120 X |
| 4,329,071 | 5/1982 | Applegate et al. | 400/120 |
| 4,375,339 | 3/1983 | Dyer et al. | 400/120 X |
| 4,384,797 | 5/1983 | Anderson et al. | 400/120 X |

FOREIGN PATENT DOCUMENTS

| | | | |
|---|---|---|---|
| 0044677 | 4/1981 | Japan | 400/120 |

OTHER PUBLICATIONS

IBM Technical Disclosure Bulletin, "Exothermic Laser Transfer Printing", Bruce et al., vol. 18, No. 12, May 1976, p. 4142.

Xerox Disclosure Journal, "Flash Transfer of Liquid Ink from a Back Screened Donor", Goffe, vol. 2, No. 3, May/Jun. 1977, p. 33.

*Primary Examiner*—Ernest T. Wright, Jr.

*Attorney, Agent, or Firm*—Davis Hoxie Faithfull & Hapgood

[57] ABSTRACT

An ink projecting medium, such as a typewriter ribbon, having a carrier, with an array of spots each including an ink or other colorant and a vapor producing material, wherein the vapor producing material amplifies applied energy by chemical reaction to propel the ink from the carrier toward a receiving surface such as paper. In one embodiment, the ink and lead azide are provided in small, conical apertures in a polyethylene terepthalate carrier film and the lead azide is selectively detonated electrically to cause printing.

9 Claims, 2 Drawing Figures

INK PROJECTING TYPEWRITER RIBBON

BACKGROUND

High speed word processing equipment has established a need for high resolution character printing which is faster and less inertially limited than the traditional percussion impact of a mechanically driven type face or matrix dot pin against a ribbon having colorant or ink which is transferred to the paper by impact pressure. Avoidance of the mechanical disadvantage of percussion impact printing has inspired such presently available techniques as electrostatically directed ink projection, xerographic techniques, and various types of thermal or light sensitive surface coatings for the paper.

BRIEF DESCRIPTION OF THE INVENTION

The present invention provides a carrier medium which may take the form of a ribbon. The carrier contains a multitude of apertures into which rapidly expanding propellant material and colorant material (ink) are deposited. Expansion of the material in a selected aperture causes a rapid projection of the ink from that aperture to the paper. A material which rapidly vaporizes, deflagrates, or explodes may serve as the propellant material. Mechanical inertia is not a limiting factor as with percussive printing, thereby permitting higher printing speeds.

THE DRAWING

DESCRIPTION OF PREFERRED EMBODIMENTS

Figure 1:
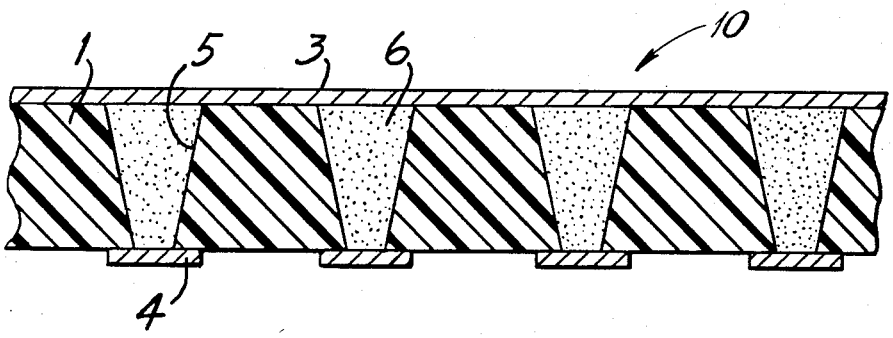
FIG. 1 is a magnified cross-sectional view of the ink carrier of the present invention.

The word "ink" is used herein to include any material which is to be conveyed to and deposited on a medium such as paper to produce printed matter and includes dry as well as liquid colorants, dyes, and materials which, when deposited on the paper, provide a visible mark. The carrier 1 is a thermally and dimensionally stable polymeric material such as polyethylene terephthalate (Mylar) in the form of a sheet or film which may be rolled and sliced to form a ribbon or tape 10. The carrier 1 is provided with a multitude of apertures 5 which extend through the thickness of the carrier 1. A typical carrier 1 thickness is 0.004 inch. The apertures 5 are arranged in a regular array of columns and rows. A typical spacing is 0.005 inch. The apertures 5 are filled with a charge 6 of an ink material such as carbon black, graphite, or an analine dye and a deflagrating or explosive propellant material such as lead azide. For concentration of the projected ink material, the aperture 5 may be conical, typically 0.005 inch at the wide end and 0.001 inch at the narrow end. The ink and propellant may be blended in a homogeneous mixture or may be stratified phases with the ink nearer the surface to be printed upon.

Lead azide can be detonated electrically. A conductive foil 3 such as aluminum overlies the face of the carrier 1 which will be adjacent the paper. Discrete patches or discs of conductive foil 4 overlie the rear of the apertures 5. The conductive foils 3 and 4 may be laminated to the carrier 1 or may be vapor deposited as an aluminized surface by well known techniques. The foils 3 and 4 may have a thickness on the order of 0.0003 inch or less.

The resistance of the charge 6 of ink and propellant with added graphite between the aluminized surfaces 3 and 4 can be made to approximate 12.5 ohms. A potential difference of 5 volts will provide $I^2R$ heating energy of about 2 watts and a current of about 400 milliamps. Given a print head speed of 10 inches per second, and a 0.001 inch diameter for the small end of the conical aperture 5, the time is 100 micro seconds for triggering each charge 6, which amounts to micro 200 watt seconds. Given the dimensions above, each charge 6 will have a volume of $2.23\times10^{-7}$ cc, a weight of approximately $4.91\times10^{-7}$ grams. Since 1-watt second=0.2389 gram calories, and the specific heat of the mixture is approximately 0.165, 2 watts of power developed across the conductive charge 6 for 100 microseconds will raise the charge 6 temperature to 586° C. above ambient. By adjusting the lead azide percentage of the mixture to detonate at 500° C., it is clear that a low Q electronic drive trigger will safely initiate detonation, while at the same time precluding accidental discharge by static electricity.

Upon detonation, lead azide will yield approximately 700 calories per gram. A 20% mixture of lead azide moderated by carbon and "ink" media will result in an explosion which raises the charge 6 temperature to approximately 850° C. over the trigger temperature in less than 10 micro seconds. Approximately 20% of the volume of the charge 6 is projected to the paper. It can be demonstrated that this quantity of propellant material will develop an energy of $0.5\times10^{-7}$ watt seconds which is more than adequate to project $1\times10^{-7}$ grams of ink material to the paper. A reduction in head traverse velocity will proportionally reduce the detonation power.

Other electrical detonation techniques include piezoelectrical, electrostatic, and electromagnetic (RF). Detonators also can be used which are selected for their radiation sensitive properties (e.g. light, IR, UV).

If mechanical detonation is preferred, the energy required is merely 200 ergs to generate the friction/heat impact needed to detonate lead azide. This is much less force than is required by conventional "carbon" typewriter ribbons thereby permitting very light, low inertia mechanics. Thermal techniques include scanning the back of the carrier 1 with a thermal beam or contact with small resistance heated spots. These non-electrical techniques do not require conductive foils.

Common to all of the above described detonation techniques is the fact that the mechanical force needed to propel the ink to the paper is derived solely from the propellant material and not from mechanical impact devices.

While the propellant material and the ink are contained in apertures 5 in the illustrated embodiment, it is apparent that they may be deposited as discrete patches on a carrier ribbon. The propellant material is selected to be capable of rapid expansion or evolution of gas to drive the ink toward the paper. Materials which rapidly burn, vaporize, or explode are suitable. Electrically non-conductive materials can be blended with conductive powders such as carbon or aluminum for electrical activation.

Figure 2:
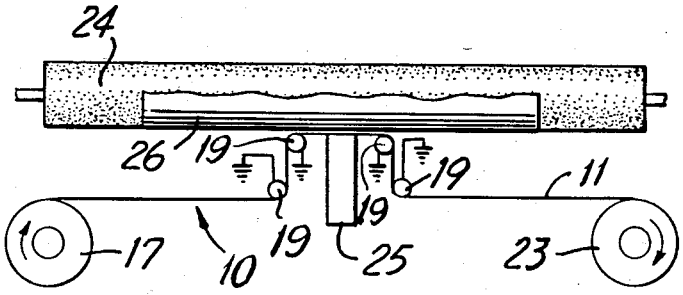
FIG. 2 is a simplified schematic of a printing apparatus which utilizes the ink carrier of the present invention.

FIG. 2 schematically illustrates a printer apparatus application of the ink projecting ribbon 10 of the present invention. The ribbon 10 is supplied from a source spool 17 and is conducted through positioning rolls 19 about a matrix head 25. Paper 26 is carried on a conventional platen 24 and may be spaced about 0.008 inch from the ribbon 10 as it passes over the head 25. Head 25 is a matrix of electrically independent electrodes arranged in a character printing matrix pattern such as 5 by 7 or 7 by 9. The conductive material 3 adjacent to the paper 26 is held at ground potential by grounding rolls 19, and electrodes of head 25 are controlled at a positive or negative voltage or current required to detonate. The electrode pattern corresponds to the pattern of apertures 5 in the ribbon 10. Energization of an electrode detonates the propellant in the corresponding ribbon aperture 5. Energization of a selected pattern of electrodes will print an entire character. Head 25 advances along the paper 26 in a manner similar to a mechanical typewriter. Spent ribbon 11 is taken up on spool 23. By making head 25 large enough with enough electrodes, an entire line can be printed at once or progressively at very high speed. A single column of electrodes rather than a character matrix can sweep along the ribbon 10 and paper 26 to print a line. Impact detonation uses tiny solenoid pins instead of electrodes. Thermal detonation uses discrete heat spots or a sweeping, pulsed beam of energy.

From the foregoing, it is clear that the mechanics of printing can be simplified greatly once the need to derive printing energy from the mechanism is reduced. An electrical detonation system requires a head 25 which weighs but 7 grams. The drive for such a light weight head 25 is very simple and inexpensive.

I claim:

1. A colorant transfer medium for printing discrete marks on a receiving surface, said medium comprising a carrier, a colorant, and a vapor producing material responsive to the application of energy, wherein the improvement comprises an array of a plurality of spots each including colorant and vapor producing material, wherein the vapor producing material comprises a chemically reactive material which, responsive to the application of said energy, produces a vapor by chemical reaction which rapidly propels the colorant toward the receiving surface.

2. A colorant transfer medium for printing discrete marks on a receiving surface, said medium comprising a carrier, a colorant, and a vapor producing material responsive to the application of energy, wherein the improvement comprises a carrier film having two surfaces and an array of apertures in one of said surfaces, each aperture containing colorant and vapor producing material, wherein the vapor producing material comprises a chemically reactive material which, responsive to the application of energy, produces a vapor by chemical reaction which rapidly propels the colorant toward the receiving surface.

3. The colorant transfer medium of claim 2 wherein the vapor producing material is lead azide.

4. The colorant transfer medium of claim 2 wherein the apertures pass through the carrier film with an aperture opening at each film surface and the carrier film has a substantially continuous film of conductive material on one carrier film surface, overlying the aperture openings on that surface.

5. The colorant transfer medium of claim 4 wherein the other carrier film surface has a plurality of discrete areas of conductive material each overlying a single aperture opening on that surface.

6. The colorant transfer medium of claim 5 wherein the vapor producing material within each of said apertures is capable of being activated to produce colorant propelling vapor by an electrical current passing through said material between the discrete area of conductive material overlying the aperture and the conductive layer.

7. The colorant transfer medium of any of claims 2 through 6 wherein the shape of the apertures is that of a truncated cone.

8. The colorant transfer medium of any of claims 4 through 6 wherein the conductive material is aluminum and the carrier film is polyethylene terepthalate.

9. The colorant transfer medium of claim 8 wherein the shape of the apertures is that of a truncated cone.

* * * * *